US010119376B2

(12) United States Patent
Cleven

(10) Patent No.: US 10,119,376 B2
(45) Date of Patent: Nov. 6, 2018

(54) METHODS AND SYSTEMS FOR MAINTAINING A PRESSURE DIFFERENTIAL BETWEEN PAIRS OF PACKERS

(71) Applicant: COMITT WELL SOLUTIONS US HOLDING INC., Katy, TX (US)

(72) Inventor: Peter Kris Cleven, Grand-Barachois (CA)

(73) Assignee: COMITT WELL SOLUTIONS US HOLDING INC., Katy, TX (US)

( * ) Notice: Subject to any disclaimer, the term of this patent is extended or adjusted under 35 U.S.C. 154(b) by 142 days.

(21) Appl. No.: 15/267,005

(22) Filed: Sep. 15, 2016

(65) Prior Publication Data

US 2018/0073339 A1 Mar. 15, 2018

(51) Int. Cl.

| | |
|---|---|
| ***E21B 43/25*** | (2006.01) |
| ***E21B 33/122*** | (2006.01) |
| ***E21B 43/26*** | (2006.01) |
| ***E21B 34/08*** | (2006.01) |
| ***E21B 43/14*** | (2006.01) |
| *E21B 43/267* | (2006.01) |

(52) U.S. Cl.

CPC ..... *E21B 43/25* (2013.01); *E21B 33/122* (2013.01); *E21B 34/08* (2013.01); *E21B 43/14* (2013.01); *E21B 43/26* (2013.01); *E21B 43/267* (2013.01)

(58) Field of Classification Search

CPC ..... E21B 43/25; E21B 33/122; E21B 43/26

See application file for complete search history.

(56) References Cited

U.S. PATENT DOCUMENTS

| | | | | |
|---|---|---|---|---|
| 3,059,699 | A | 10/1962 | Brown | |
| 4,840,231 | A | 6/1989 | Berzin | |
| 6,202,742 | B1 | 3/2001 | Echols | |
| 2002/0162660 | A1* | 11/2002 | Depiak | E21B 33/124 166/308.1 |

* cited by examiner

*Primary Examiner* — Zakiya W Bates
*Assistant Examiner* — Crystal J Miller
(74) *Attorney, Agent, or Firm* — Pierson IP, PLLC

(57) ABSTRACT

Examples of the present disclosure relate to systems and methods for fracturing systems that maintain a substantially constant pressure differential between a first pressure zone and a second pressure zone.

20 Claims, 3 Drawing Sheets

METHODS AND SYSTEMS FOR MAINTAINING A PRESSURE DIFFERENTIAL BETWEEN PAIRS OF PACKERS

BACKGROUND INFORMATION

Field of the Disclosure

Examples of the present disclosure relate to systems and methods for injection systems that maintain a substantially constant pressure differential between a first pressure zone and a second pressure zone.

Background

Hydraulic injection explained in this document thereafter as fracturing for simplicity is performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

Conventionally, to generate sufficient pressure to create the fractures in the formations, systems utilize a pair of packers to isolate zones of interest. Conventionally, the pair of packers are set by increasing the pressure within a coiled tube. After sealing a zone of interest, a further increase in pumping fluid correspondingly increases the pressure within the coiled tube to open a valve. This allows a fracturing treatment to be applied to the zone of interest. Once fracturing treatment is completed, the pumping pressure may decrease. This causes the valve to close and the packers to unset. To this end, conventional systems utilize pressure within the coil tubing to set and unset packers and open and close frac ports.

Accordingly, needs exist for system and methods for fracturing systems that in a first mode maintain a substantially constant pressure differential between a first pressure zone within a tool between a pair of packers and a second pressure zone outside of the tool between the pair of packers, and in a second mode have equalized pressure between three pressure zones.

SUMMARY

Embodiments disclosed herein describe fracturing methods and systems that maintain a substantially constant pressure differential between an inner diameter of a tool and an annulus. In embodiments, once a tool is activated, multiple pressure zones with different pressures may be created. A first pressure zone may be created within the inner diameter of the tool, which may be in a position between packers, a second pressure zone may be created outside of the tool between two sealing packers, and a third pressure zone may be created outside of the sealing packers and outside the tool. Responsive to deactivating the tool, the multiple pressure zones may have equal pressures.

In embodiments, a tool may include an upper packer, a lower packer, a vent, a vent hole, a central gate, a valve, and a flow activated valve with a debris filter.

In a first mode, the tool may be deactivated to equalize the pressure across different zones associated with the tool. While in the first mode, fluid may flow through the tool. The fluid flowing through the tool may activate the flow activated valve and the upper packer, lower packer, and gate, which may place the tool in a second mode. When the flow activated valve is activated, upper packer and the lower packer are activated thereafter, causing the first pressure zone may be created, the second pressure zone may be created, and the third pressure zone may be created. The pressure within the first pressure zone may correlate with the pressure within the second pressure zone.

Responsive to ceasing the fluid flow through the inner diameter of the tool, the tool may return to the first mode from the second mode. Furthermore, when ceasing the fluid flow through the inner diameter of the tool, the flow activated valve may be deactivated to eliminate residual pressure, which may maintain the tool in the second mode.

In embodiments, if pressure within a third pressure zone positioned below the tool and the lower packer is lower than the pressure within the first pressure zone and/or the second pressure zone, the flow activated valve may not be able to be deactivated. To alleviate this potential issue, the vent is configured to directly connect a treating annulus pressure associated with the first pressure zone and the second pressure zone with the third pressure zone via the vent hole. Accordingly, due to the positioning of the vent hole below the lower packer and above the flow activated valve, while in the first mode the pressure zones may be in communication with each other to equalize the pressure zones.

In embodiments, responsive to ceasing the fluid flow through the inner diameter of the tool, the gate and the vent may return to their positioning in the first mode based on the pressure within the first pressure zone and the second pressure zone. Furthermore, a vent positioned through the lower packer may be coupled with a sealing sleeve. This sealing sleeve may be configured to cover and uncover the vent hole to not allow or allow communication between the pressure zones. The sealing sleeve may operate based on the pressures within the first pressure zone and the second pressure zone. The connections of the pressure zones via the tube and sliding sleeve covering and uncovering the vent hole may eliminate the risk of a pressure differential within the pressure zones. The equalizing of the pressure zones may eliminate the risk of the flow activated valve remaining in a set or activated position when fluid is not flowing through the inner diameter of the tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
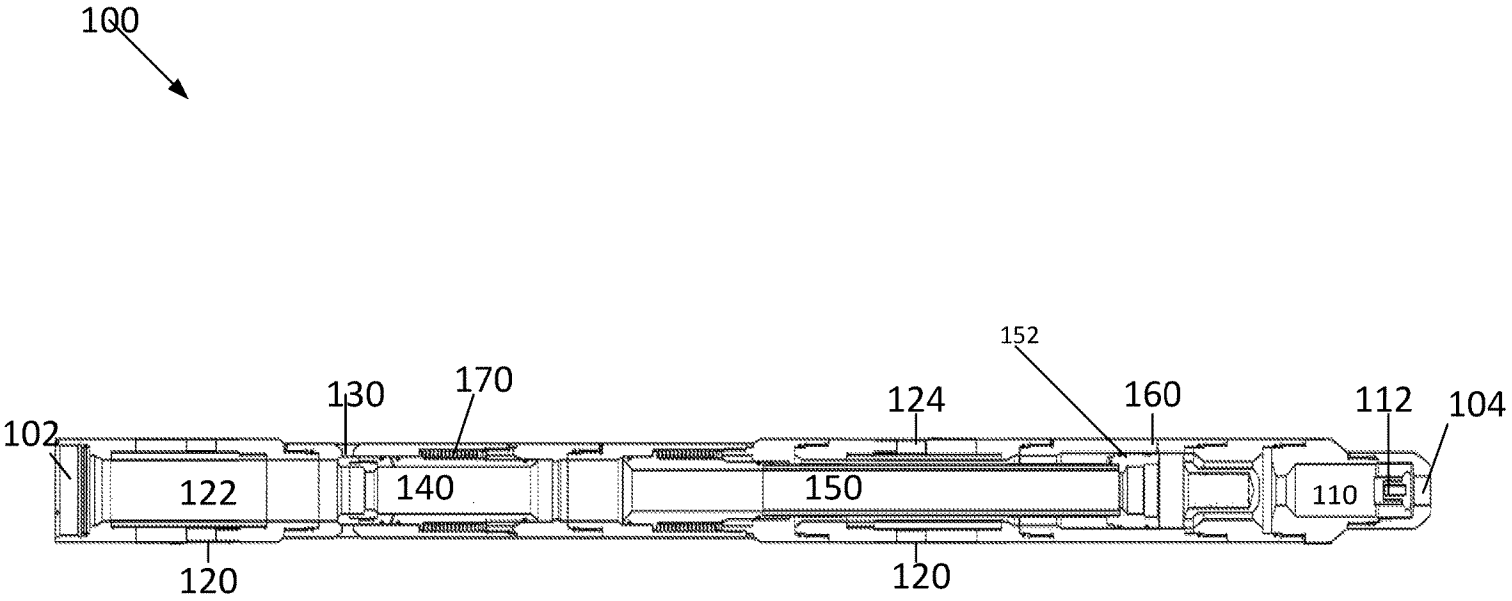
FIG. 1 depicts a tool in a first mode, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

In embodiments, a hole may be run with tubing. The tubing may be a pipe, coil, etc. extending from a surface level into a geological formation. Then a tool may be positioned within the tubing.

FIG. 1 depicts a tool 100, according to an embodiment. Tool 100 may include a hollow chamber extending from a proximal end 102 of tool 110 to a distal end 104 of tool 110. Fluid may be pumped through tool 100 to move the tool 100 from a first mode (activated) to a second mode (deactivated). When fluid ceases to flow within the tool 100, tool 100 may move from the second mode to the first mode. Tool 100 may include a flow activated valve 110, a packer pair 120 with an upper packer 122 and a lower packer 124, a valve 130, a gate 140, a vent 150, a vent hole 160, a linear adjustable member 170.

flow activated valve 110 may be a valve configured to be positioned proximal to distal end 104 of tool 100. However, flow activated valve 110 may be any type of closing mechanism. flow activated valve 110 may include a valve 112 that is configured to move in a linear axis in parallel to the longitudinal axis of tool 100. In the first mode, valve 112 may be configured to not cover the distal end 104 of tool 100. In the second mode, valve 112 may be configured to cover and seal the distal end 104 of tool 100. Responsive to valve 112 covering distal end 104 of tool 100, upper packer 122 and lower packer 124 may be set.

Packer pair 120 may include upper packer 122 and lower packer 124. Both upper packer 122 and lower packer 124 may include a sealing element that expands radially. When compressed, the upper packer 122 and lower packer 124 may be set and engage the wellbore wall. Upper packer 122 and lower packer 124 may be unset by contracting the sealing element to disengage from the wellbore wall, such that the sealing element does not touch the wellbore wall. In embodiments, upper packer 122 and lower packer 124 may be set responsive to valve 112 covering distal end 104 of tool 100.

Valve 130 may be a port within tool 100 that extends through the sidewalls of tool 100. Fluid may be configured to flow through valve 130 to allow a fracturing process to take place when gate 140 is not covering valve 130. Fluid may not be able to flow through valve 130 when gate 140 covers valve 130.

Gate 140 may be a flow diverter valve with a first piston configured to move in a linear axis in parallel to the longitudinal axis of tool 110. Gate 140 may be configured to move along the linear axis to cover and uncover valve 130. In embodiments, responsive to tool 100 being in the second mode, gate 140 may be open and may cover valve 130, such that fluid may be diverted through gate 140 and out of valve 130. When tool 100 is in the first mode, gate 140 may be closed and cover valve 130. Accordingly, gate 140 may cover and uncover valve 130 based on a fluid flow rate through the inner diameter of tool 100. In embodiments, gate 140 may operate utilizing the first piston that moves based on a pressure differential within a first pressure zone and a second pressure zone, wherein the first pressure zone and the second pressure zone are within a treatment zone between upper packer 122 and lower packer 124. This may be different than conventional tools that operate based on a pressure differential within the treatment zone between the packers and outside of the packers.

Vent 150 may be a vented tube that is configured to move in the linear axis in parallel to the longitudinal axis of tool 100 utilizing a second piston. Vent 150 may have a first opening that is positioned within the treatment zone and a second opening that is positioned below the treatment zone. The second end of vent 150 may be coupled with a sliding sleeve 152, wherein the sliding sleeve 152 is configured to cover and uncover vent hole 160. Vent hole 160 may be an orifice, opening, hole, etc. positioned through tool 100, wherein vent hole 160 may be positioned below the second end of vent 150 and above flow activated valve 110.

In embodiments, responsive to tool 100 being in the second mode, the second piston may move vent 150 and the sliding sleeve to cover vent hole 160. Responsive to tool 100 being in the first mode, the second piston may move vent 150 and the sliding sleeve to no longer cover vent hole 160. Therefore, via the second piston and the sliding sleeve, vent 150 may control a constant pressure differential between the first pressure zone and the second pressure zone that is not based on the third pressure zone. When the sliding sleeve is not covering vent hole 160, the pressures within the first, second, and third pressure zones may be equalized.

In different embodiments, vent 150 and vent hole 160 may be positioned at various locations with tool 100. For example, in an embodiment, vent 150 and vent hole 160 may be positioned above packer pair 120 or between the packer pair 120.

Linear adjustable member 170 may be a device or fluid chamber that is configured to assist in moving gate 140 to control a pressure differential between the first pressure zone and the second pressure zone. For example, the linear adjustable member 170 may be a spring, hydraulic lift, etc. Responsive to setting the packers 120 such that tool 100 is in the second mode, the pressure differential between the first pressure zone and the second pressure zone may cause linear adjustable member 170 to compress. Responsive to being in the first mode, the pressure differential between the three pressure zones may allow linear adjustable member 170 to be elongated. Furthermore, linear adjustable member 170 may be configured to create a substantially constant pressure differential between the first pressure zone and the second pressure zone while tool 100 is transitioning between modes or is set in the second mode. For example, while fluid is flowing through the inner diameter of tool 100 to set packers 120, the pressure differential between the first pressure zone and the second pressure zone may be substantially similar to a first pressure constant, such as 800 PSI. When tool 100 is in the second mode and packers 120 are set, the pressure differential between the first pressure zone and the second pressure zone may remain at the first pressure constant. In embodiments, the first pressure constant may be a PSI between 700 and 900. However, embodiments may be configured to operate with pressure zones operating within all levels of PSI.

Figure 2:
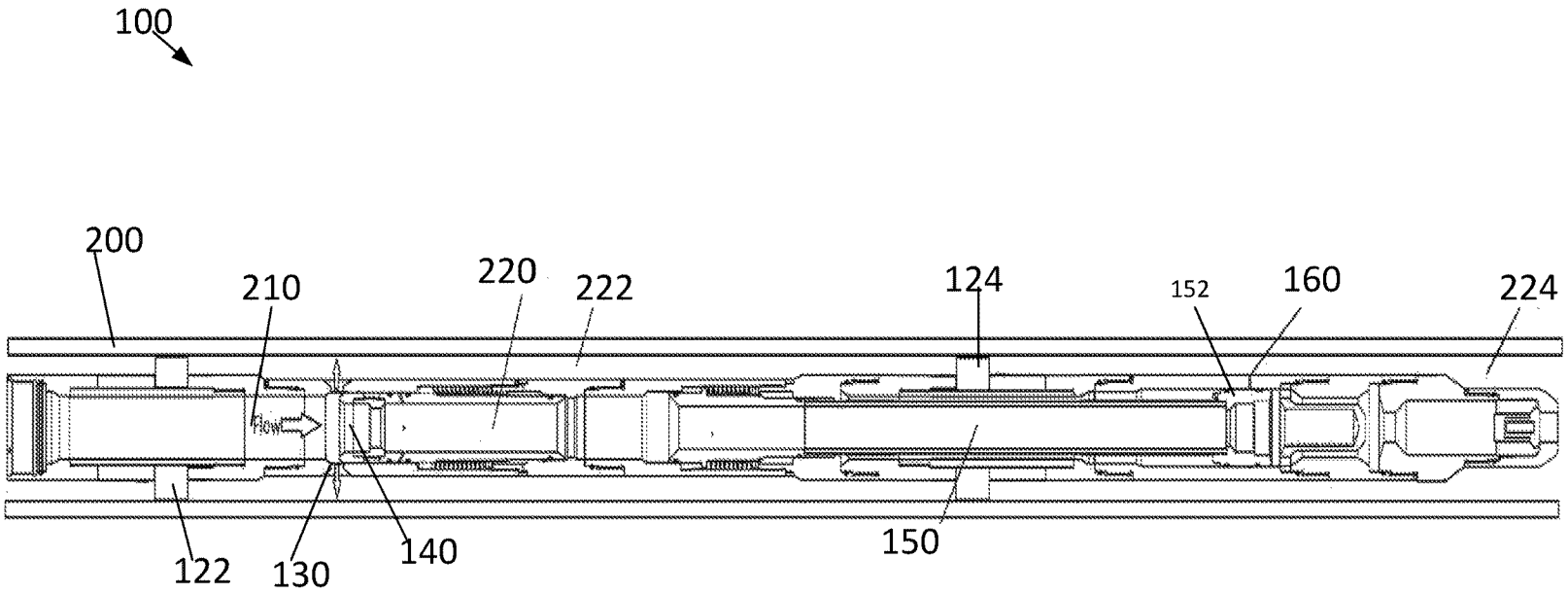
FIG. 2 depicts a tool in the second mode, according to an embodiment.

FIG. 2 depicts tool 100 in the second mode, according to an embodiment. Elements depicted in FIG. 2 may be substantially similar to those described above. Therefore, for the sake of brevity a further description of these elements is omitted.

As depicted in FIG. 2, tool 100 may be positioned within tubing 200, and fluid 210 may be flowing through the inner diameter of tool 100. Responsive to the fluid flow rate within the inner diameter of tool 100 being above a flow threshold, flow activated valve 110 may activate by sealing distal end 104 of tool 100. This may cause the upper packer 122 and lower packer 124 to be set. When setting upper packer 122 and lower packer 124, a first pressure zone 220 may be created within the inner diameter of tool 100 between the packers 120, a second pressure zone 222 may be created in an annulus between tool 100 and tubing 200 that is between packers 120, and a third pressure zone 224 may be created in the annulus below lower packer 124. As discussed above, the pressure differential between the first pressure zone 220 and the second pressure zone 222 may be substantially constant.

As further depicted in FIG. 2, when tool 100 is in the second position, the first piston may slide towards the distal end 104 of tool 100 to allow fluid to flow through gate 140 and valve 130.

In embodiments, responsive to transitioning tool 100 from the second mode to the first mode by ceasing the flow of fluid 210 through the inner diameter of tool 100, flow activated valve 110 may require deactivation to eliminate hydrostatic pressure that may keep tool 100 in the first mode. If the pressure in the third pressure zone 224 is lower than that of the first or second pressure zone 220, 222, then flow activated valve 110 may not deactivate, which may keep tool 100 activated in the second mode. To alleviate this issue, vent 150 is configured to directly connect a treating annulus pressure in the first and second pressure zone 220, 222 with the third pressure zone 224 via vent hole 160. More specifically, responsive to ceasing fluid flow through the inner diameter of tool 100, a sliding sleeve may no longer cover vent hole 160 allowing the pressure within in zones to be substantially equal, which may eliminate the risk of flow activated valve 110 remaining activated. In embodiments, gate 140 may not be configured to fully close. This may allow the first pressure zone 220 and second pressure zone 222 to balance directly with minimal restriction. This may allow each of the pressure zones 220, 222, 224 to balance properly.

Figure 3:
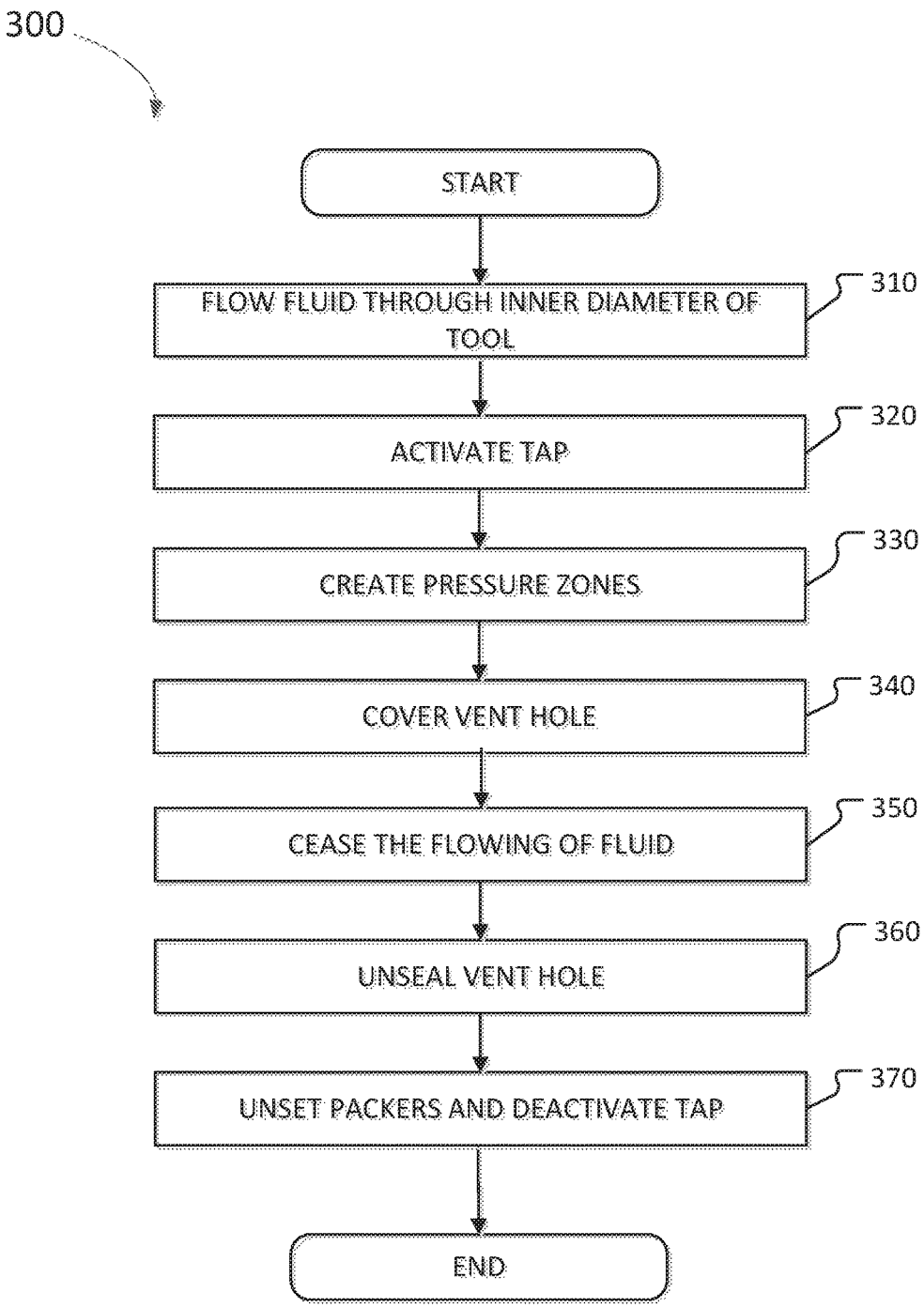
FIG. 3 depicts a method for creating pressure zones associated with a tool, according to an embodiment.

Furthermore, the pressure pushing from the second pressure zone 222 against the rubber or expandable elements on the packer pair 120 when packer pair 120 is set, may be in the opposite direction that the expandable elements need to unset. Accordingly, this pressure pushing on the expandable elements on the packer pair 120 may also be working against tool 100 from deactivating when the pressure within the second pressure zone 222 is greater than the third pressure zone 224. If a piston created on the expandable elements is greater than a piston of the packer pair 120, then packer pair 120 may remain stuck or self-activated with the high pressure levels coming out of the completion of the second pressure zone 222. The pressure bleed off within gate 140 and/or the vent hole 150 may balance the pressure with the pressure zones 220, 222, 224 and eliminate the possibility of the packer pair 120 remaining activated in undesirable situations. FIG. 3 depicts a method 300 for creating pressure zones associated with a tool, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, fluid may flow within an inner diameter of a tool to activate a flow activated valve.

At operation 320, responsive to activating the flow activated valve, an upper packer and a lower packer may be set to form a first pressure zone, a second pressure zone, and a third pressure zone.

At operation 330, a pressure differential between the first pressure zone and a second pressure zone may slide a gate towards a distal end of the tool. This may allow fluid flowing though the inner diameter to flow out of the tool in a treatment zone between the packers. Furthermore, a linear adjustable member may maintain a substantially constant pressure differential between the first pressure zone and the second pressure zone.

At operation 340, a second piston may move a vent and a sliding sleeve towards the distal end of the tool. When moving the sliding sleeve, the sliding sleeve may cover a vent hole. This may seal communication between the third pressure zone and the first and second pressure zones.

At operation 350, fluid may cease to flow through the inner diameter of the tool.

At operation 360, responsive to stopping the fluid flowing through the inner diameter of the tool, the vent and the sliding sleeve may move towards the proximal end of the tool. This may unseal the vent hole, which may allow communications between each of the pressure zones.

At operation 370, the flow activated valve and the packers may be unset to deactivate the tool, and equalize the three pressure zones.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for stimulating a well comprising: a flow activated valve positioned proximate to a distal end of a tool, the flow activated valve being configured to move towards the distal end to the tool to seal a hole located at the distal most end of the tool responsive to flowing fluid through an inner diameter of the tool;

a packer pair configured to expand responsive to the flow activated valve sealing the distal most end of the tool, the packer pair including an upper packer and a lower packer;

a vent including a first end positioned above the lower packer and a second end positioned below the lower packer, the second end of the vent being coupled with a sliding sleeve, the sliding sleeve being configured to cover a vent hole through the tool responsive to the packer pair sealing against a wellbore wall, the vent hole extending laterally through the tool from the inner diameter of the tool to an annulus;

a first pressure zone positioned within the inner diameter of the tool;

a second pressure zone positioned outside of the tool between the upper packer and the lower packer;

a linearly adjustable member configured to maintain a substantially constant pressure differential between the first pressure zone and the second pressure zone when the packers are sealing against the wellbore wall.

2. The system of claim 1, further comprising:

a third pressure zone positioned outside of the the tool below the lower packer, wherein when the sliding sleeve covers the vent hole the third pressure zone is not in communication with the first pressure zone or the second pressure zone.

3. The system of claim 2, wherein the flow activated valve is configured to not seal the distal most end of the tool responsive to ceasing the fluid flowing through the inner diameter of the tool, and when ceasing the fluid flow through the inner diameter of the tool the sliding sleeve does not cover the vent hole.

4. The system of claim 3, wherein the first pressure zone, the second pressure zone, and the third pressure zone are in communication with each other when the sliding sleeve does not cover the vent hole.

5. The system of claim 4, wherein the flow activated valve is deactivated when ceasing the fluid flowing through the inner diameter of the tool based on the communication between the first pressure zone, the second pressure zone, and the third pressure zone.

6. The system of claim 1, further comprising;

a gate configured to move in a linear axis in parallel to the longitudinal axis of the tool and to cover a valve when the flow activated valve is not sealing the distal most end of the tool.

7. The system of claim 6, wherein the gate is configured to not cover the valve when the flow activated valve is sealing the distal most end of the tool.

8. The system of claim 6, wherein the gate is positioned between the upper packer and the lower packer.

9. The system of claim 1, wherein the substantially constant pressure differential is a positive value.

10. The system of claim 1, wherein the linearly adjustable member is configured to compress as a fluid flow rate through the inner diameter of the tool increases to maintain a substantially constant pressure differential.

11. A method for stimulating a well comprising:

positioning a flow activated valve proximate to a distal end of a tool;

moving the flow activated valve towards the distal end of the tool to seal a hole positioned on the distal most end of the tool responsive to flowing fluid through an inner diameter of the tool;

expanding a packer pair responsive to the flow activated valve sealing the distal most end of the tool, the packer pair including an upper packer and a lower packer;

moving a sliding sleeve coupled to a vent to cover a vent hole, the vent hole extending laterally through the tool from the inner diameter of the tool to an annulus responsive to the packer pair sealing against a wellbore wall, wherein the vent includes a first end positioned above the lower packer and a second end positioned below the lower packer, the sliding sleeve being coupled to the second end;

creating a first pressure zone positioned within the inner diameter of the tool;

creating a second pressure zone positioned outside the the tool between the upper packer and the lower packer;

maintaining, via a linearly adjustable member, a substantially constant pressure differential between the first pressure zone and the second pressure zone when the packers are sealing against the wellbore wall.

12. The method of claim 11, further comprising:

creating a third pressure zone positioned outside of the the tool below the lower packer, wherein when the sliding sleeve covers the vent hole the third pressure zone is not in communication with the first pressure zone or the second pressure zone.

13. The method of claim 12, further comprising:

not sealing the distal most end of the tool by the flow activated valve responsive to ceasing the fluid flowing through the inner diameter of the tool, and when ceasing the fluid flow through the inner diameter of the tool the sliding sleeve does not cover the vent hole.

14. The method of claim 13, wherein the first pressure zone, the second pressure zone, and the third pressure zone are in communication with each other when the sliding sleeve does not cover the vent hole.

15. The method of claim 14, further comprising:

de-activing the flow activated valve when ceasing the fluid flowing through the inner diameter of the tool based on the communication between the first pressure zone, the second pressure zone, and the third pressure zone.

16. The method of claim 11, further comprising:

moving a gate configured in a linear axis in parallel to the longitudinal axis of the tool to cover a valve when the flow activated valve is not sealing the distal most end of the tool.

17. The method of claim 16, wherein the gate is configured to not cover the valve when the flow activated valve is sealing the distal most end of the tool.

18. The method of claim 16, wherein the gate is positioned between the upper packer and the lower packer.

19. The method of claim 11, wherein the substantially constant pressure differential is a positive value.

20. The method of claim 11, further comprising:

compressing the linearly adjustable member configured as a fluid flow rate through the inner diameter of the tool increases to maintain a substantially constant pressure differential.

* * * * *